US008697326B2

(12) United States Patent
Suzuki et al.

(10) Patent No.: US 8,697,326 B2
(45) Date of Patent: Apr. 15, 2014

(54) METHOD OF MANUFACTURING A CARRIER, A CARRIER, A DEVELOPMENT AGENT, AND A PROCESS CARTRIDGE

(75) Inventors: Kousuke Suzuki, Shizuoka (JP); Shinichiro Yagi, Shizuoka (JP); Masato Taikoji, Kanagawa (JP); Masanori Rimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 40 days.

(21) Appl. No.: 13/169,406

(22) Filed: Jun. 27, 2011

(65) Prior Publication Data

US 2012/0008979 A1 Jan. 12, 2012

(30) Foreign Application Priority Data

Jul. 6, 2010 (JP) ..... 2010-153571
Feb. 21, 2011 (JP) ..... 2011-034567
Mar. 17, 2011 (JP) ..... 2011-059112

(51) Int. Cl.
*G03G 5/00* (2006.01)
*G03G 9/00* (2006.01)

(52) U.S. Cl.
USPC ..... 430/137.13; 430/111.3; 427/458

(58) Field of Classification Search
USPC ..... 430/111.1, 111.3, 111.31, 137.1, 430/137.13; 427/458, 475, 486
See application file for complete search history.

(56) References Cited

U.S. PATENT DOCUMENTS

| | | | | |
|---|---|---|---|---|
| 4,209,550 | A * | 6/1980 | Hagenbach et al. | 427/486 |
| 2003/0186154 | A1* | 10/2003 | Suzuki et al. | 430/111.1 |
| 2006/0134344 | A1* | 6/2006 | Kitahata et al. | 427/458 |
| 2006/0210906 | A1 | 9/2006 | Suzuki et al. | |
| 2006/0228641 | A1* | 10/2006 | Suzuki et al. | 430/111.32 |

FOREIGN PATENT DOCUMENTS

| | | |
|---|---|---|
| CN | 1704852 A | 12/2005 |
| JP | 2-51177 | 11/1990 |
| JP | 9-304959 | 11/1997 |
| JP | 9-329910 | 12/1997 |
| JP | 2001-312093 | 12/1997 |
| JP | 2006-154453 | 6/2006 |
| JP | 2007-102159 | 4/2007 |
| JP | 2007-286078 | 11/2007 |
| JP | 2008-70837 | 3/2008 |

OTHER PUBLICATIONS

Chinese official action dated Jan. 31, 2013 in connection with corresponding Chinese patent application No. 2011-10787739.4.

* cited by examiner

*Primary Examiner* — Stewart Fraser
(74) *Attorney, Agent, or Firm* — Cooper & Dunham LLP

(57) ABSTRACT

A method of manufacturing a carrier including covering a core material with a covering material to form a covering layer on the core material and baking the covering material by heating the core material by high frequency induction applied thereto by a high frequency induction heating device.

12 Claims, 1 Drawing Sheet

METHOD OF MANUFACTURING A CARRIER, A CARRIER, A DEVELOPMENT AGENT, AND A PROCESS CARTRIDGE

BACKGROUND OF THE INVENTION

1. Field of the Invention

The present invention relates to a method of manufacturing a carrier, a carrier, a development agent, and a process cartridge.

2. Description of the Background Art

In electrophotography, images are formed by forming a latent electrostatic image by electrostatic charge on an image bearing member formed of photoconductive materials, etc., attaching charged toner particles to the latent electrostatic image to obtain a toner image, transferring the toner image to a recording medium such as paper, and fixing the toner image.

In recent years, the technologies regarding photocopiers and printers employing electrophotography have been rapidly diffusing from monochrome field to full color field, thereby expanding the full color market.

In color image forming employing full color electrophotography, four color toners containing toners of three primary colors of yellow, magenta, and cyan and black are laminated for representing all the colors.

Therefore, to obtain vivid full color images with excellent color representation, the surface of the fixed toner image is smoothed in some degree to reduce light scattering. Therefore, most of the image gloss of images produced by a typical full color photocopier, etc. ranges from middle gloss to high gloss, e.g., 10 to 50%.

In general, as a method of fixing dry toner images on a recording medium, a contact heating fixing method is commonly used in which a heated roller or belt is pressed against the toner.

This method is advantageous in terms of heat efficiency, speed of fixing, imparting gloss and transparency to color toner. However, in this method, since melted toner is peeled off from the surface of a heated fixing member after the melted toner contacts the surface under pressure, part of the toner image may be attached to the surface, resulting in transfer of the attached toner to another recording medium on which another toner image is formed. This is referred to as offset phenomenon.

To prevent the offset phenomenon, in general, a heating fixing member having a surface formed of materials having excellent releasing property such as silicone rubber and fluorine resins is used and in addition releasing oil such as silicone oil is applied to the surface of the heating fixing member.

However, this method is extremely effective to prevent offset of toner but requires a device to supply the releasing oil, thereby not shrinking but expanding the size of a fixing device. Therefore, a monochrome toner tends to be used in a method in which the viscous elasticity of the toner in melted state is improved by adjusting the molecular weight distribution of the binder resin to prevent fracturing of the melted toner from inside and furthermore a releasing agent such as wax is contained to apply no (oil free) or few amount of releasing oil to a fixing roller.

Similarly, such an oil-free application has become common for color toner in terms of size reduction of a machine and simplification of the structure thereof.

However, as described above, since the surface of a fixed image is required to be smooth to improve the color representation of color toner, toner in melted state having a low viscous elasticity is suitable. Therefore, color toner causes offset phenomenon more easily than monochrome toner, which does not require gloss. That means that it is more difficult to employ a method of applying no (oil free) or few amount of releasing oil to a fixing roller in the case of color toner. In addition, when a toner containing a releasing agent is used, the attachability of the toner increases, thereby degrading the transfer property of the toner to a transfer medium and resulting in contamination of a triboelectric member such as carriers by the releasing agent, which leads to degradation of the chargeability and durability. Furthermore, in consideration of the environment, toner having a low fixing temperature has been dominantly used to reduce the power consumption. Such toner tends to be inferior to typical toner in terms of preservability in a high temperature and high moisture environment.

In addition, carriers have been used to meet the demand for forming more beautiful images faster. As the speed of image forming increases, a development agent containing carrier and toner particles are subjected to increasing stress, which leads to a short working life of the carrier although carriers have a long working life in general.

Furthermore, to produce higher quality images, it is effective to reduce color contamination ascribable to the color deriving from the carrier covering resin. However, if the covering resin is heated and processed in a low temperature to reduce the color contamination, the amount of residual solvent in the covering resin tends to increase and the degree of the cross-linking in the covering resin tends to decrease, which leads to solidification (i.e., a phenomenon in which carrier and toner particles stick together to form blocks) in a high temperature and high moisture environment.

For example, when a fresh development agent is placed in a development unit, the toner easily falls from a case that contains the toner to the development unit but the solidified development agent does not easily drop so that the development agent is not transferred into the unit sufficiently and therefore defective images may be produced. In addition, if the solidified blocks remain in the development agent that has been transferred into the unit, the blocks are caught at a regulation board where the amount of the development agent on the development roller is uniformly adjusted.

Thus, the development agent is hauled onto some part of the surface of the development roller but not the other part thereof, resulting in production of defective images. Moreover, if the development agent is solidified in the development unit or the development agent is placed in the development unit in the first place and solidified to a degree beyond which the stirring wing in the development unit does not crumble the solidified blocks, problems arise such that defective images are easily produced and the development unit is unable to function.

One of the deduced mechanism of such problems is that the specific surface of the carrier and the toner increases as the particle diameter of the carrier and the toner decreases. Also such problems can be ascribable to low temperature fixing and oil-free application. Furthermore, other inferable factors causing problems deriving from solidification are consequential size reduction of a development unit to meet the demand for size reduction of an entire machine and difficulty of designing of falling of a development agent.

Moreover, as a result of diversification of the market, the use of a product is required to be guaranteed in a wide range of environments. Consequently, a development agent having a tough quality is demanded.

To solve these problems, Japanese patent application publication No. (hereinafter referred to as JP-A) 2006-154453 describes a method of raising the baking temperature of resin covered carriers in an electric furnace to improve the problem of solidification. However, the covered resin baked at a higher temperature tends to have blackish color. Therefore, this method is not suitable for the color contamination problem.

The solidification problem that has not happened before is now recognized as an issue for a development agent. By contrast, solidification of toner has been already recognized. For example, JP H02-051177-A, JP H09-304959, JP-H09-329910-A, and JP 2001-312093 describe the solidification of simple toner but not a development agent containing toner and carrier.

To deal with such problems, for example, JP 2007-102159 and JP 2008-70837 describe carriers that contain particles larger than the film covering the carriers. Furthermore, JP 2007-286078-A describes a method of performing development while discharging extra development agent in the development unit described above in addition to replenishment of toner and carrier to the development unit.

In addition, with regard to carriers, the demand for forming more beautiful images faster is strong as described above. Therefore, the development roller is driven to rotate faster and faster in line with appearance of a high speed machine of late, resulting in an increase of centrifugal applied to the development agent.

The particle diameter of carrier and toner has been markedly reduced to meet the demand for improvement on the quality of images.

Therefore, the particle diameter is irrelevant to an increase of the centrifugal caused by high speed performance as long as the magnetization remains unchanged (magnetization per weight is the same). However, with regard to size reduction of toner and carrier particles for improvement on the quality of images, since the surface area per unit weight increases as the particle diameter decreases, the amount of charge increases against magnetization.

That is, the carrier tends to be weakly attracted by the electric force of the image bearing member so that carrier attachment easily occurs.

SUMMARY OF THE INVENTION

In view of the foregoing, the present invention provides a method of manufacturing a carrier including covering a core material with a covering material to form a covering layer on the core material and baking the covering material by heating the core material by high frequency induction applied thereto by a high frequency induction heating device.

It is preferred that, in the method of manufacturing a carrier, the covering layer contains a covering resin, the covering resin being cross-linked in the step of baking.

It is still further preferred that, in the method of manufacturing a carrier, a magnetic field generated by the high frequency induction heating device is generated by flowing a current in a conductive wire having a coil form having a single turn or multiple turns.

It is still further preferred that, in the method of manufacturing a carrier, the core material covered with the covering material is placed in an inner side the conductive wire having a coil form.

It is still further preferred that, in the method of manufacturing a carrier, the core material covered with the covering material is transferred continuously in the magnetic field to apply magnetic lines of force to the core material.

It is still further preferred that, in the method of manufacturing a carrier, the core material covered with the covering material is transferred continuously by a belt.

It is still further preferred that, in the method of manufacturing a carrier, the core material covered with the covering material is transferred continuously by a screw.

It is still further preferred that, in the method of manufacturing a carrier, the core material covered with the covering material is transferred continuously by vibration.

It is still further preferred that, in the method of manufacturing a carrier, an electric power E of the high frequency induction heating device per unit of weight of the carrier is represented by the following relationship 1 and ranges from 0.01 to 2.5 kWh/kg, $$E=W/M \qquad \text{Relationship 1}$$

where W represents electric power per unit of time, M represents a weight of the carrier processed per hour.

It is still further preferred that, in the method of manufacturing a carrier, the output voltage of the high frequency induction heating device ranges from 200 to 1,500 V.

It is still further preferred that, in the method of manufacturing a carrier, a holding time of the temperature of the baking by the high frequency induction heating device ranges from 0 to 60 minutes.

As another aspect of the present invention, a carrier is provided which includes a core material and a covering layer formed on the surface of the core material and the carrier is manufactured by the method described above.

As another aspect of the present invention, a development agent is provided which includes the carrier mentioned above and a toner.

As another aspect of the present invention, a development agent for replenishment is provided which includes the carrier mentioned above and toner, wherein the blend ratio by weight of the toner to the carrier is from 2/1 to 50/1.

As another aspect of the present invention, a process cartridge is provided which includes an image bearing member to bear an image thereon, a development device to accommodate the carrier mentioned above and a toner and provide the toner to the image bearing member, and at least one device selected from the group consisting of a charging device, an irradiation device, a transfer device, a cleaning device, and a discharging device, wherein the process cartridge is detachably attachable to an image forming apparatus.

As another aspect of the present invention, a process cartridge is provided which includes an image bearing member to bear an image thereon, a development device to accommodate the development agent mentioned above and provide the toner to the image bearing member, and at least one device selected from the group consisting of a charging device, an irradiation device, a transfer device, a cleaning device, and a discharging device, wherein the process cartridge is detachably attachable to an image forming apparatus.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Figure 1:
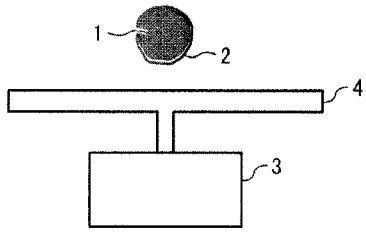
FIG. 1 is a diagram illustrating a heating method by high frequency induction heating in the present disclosure.

The present disclosure is described in detail with reference to accompanying drawings.

The present inventors have made an intensive study about the problems described above and found that the problems are significantly improved by employing a method of manufacturing carrier formed of a core material and a covering (material) layer formed thereon which includes a step of covering the core material with the covering material and a step of baking the covering material layer with heat in which the core material is heated by high-frequency induction by a high-frequency induction heating device (heater) to heat the covering material.

That is, in the baking by high-frequency induction heating, eddy-current flows in the core material by magnetic lines of force generated by a conductive material (body) in which a high-frequency current flows. Since the core material has an electric resistance (R), Joule heat (Q=Wt) corresponding to the electric power (W=I×I×R) generated by the current I and the resistance R is generated to heat the core material, thereby heating the covering layer, resulting in drying of the residual solvent in the covering layer and promotion of cross-linking reaction of the covering material. Therefore, since the covering layer of each particle of the carrier can be heated from inside and the residual solvent starts drying from inside, the solvent easily passes through the covering layer to the outside. As a result, the amount of the residual solvent tends to be small.

By contrast, since a typical baking machine such as an electric furnace and a rotary kiln heats the core material that is covered with the covering material from outside, drying of the covering layer and cross-linking reaction start from outside. Therefore, the residual solvent present inside is difficult to pass through to the outside, which makes it difficult to reduce the amount of the residual solvent.

Furthermore, it is also found that heating treatment of the covering layer described above accompanies cross-linking reaction, thereby significantly improving the effect.

That is, with regard to the cross-linking reaction of the covering material, in the baking by high-frequency induction heating, since the covering layer of each particle of the carrier can be heated from inside, any of the covering layers is equally heated so that the covering layers of all the carrier particles can be placed uniformly in the cross-linking reaction.

By contrast, since a typical baking machine such as an electric furnace and a rotary kiln heats the core material that is covered with the covering material from outside, a desired amount of heat enters into the carrier particles present closer (i.e., outside) to the heat source but is not conveyed into the carrier particles arranged on the far side thereof properly. Therefore, progress of the cross-linking reaction in the entire carrier is not uniform, thereby making it difficult to place the entire carrier in a uniform cross-linking reaction state.

The residual solvent in the covering layer and un-cross-linked covering material are disadvantageous in terms of the solidification described above of the development agent preserved in a high temperature and high moisture environment and significantly degrade the preservability. In addition, to improve the preservability, typically the baking temperature is raised. However, since this temperature raise is disadvantageous for the color contamination, the method of raising the baking temperature has limitations and should be determined considering the trade-off between the solidification and the color contamination. By contrast, in the baking by high-frequency induction heating of the present disclosure, since the drying and the cross-linking reaction in the covering layer proceed efficiently as described above, the baking temperature can be set to be lower than the temperature set in a typical manner.

In addition, the same applies to the cross-linking reaction. That is, carrier particles existent on the surface of the laminate carrier layer is excessively heated to supply heat to the particles present inside the layer in a typical case but since uniform heating is made possible by employing the high-frequency induction heating, a lower baking temperature can be set, thereby enabling improvement of the color contamination problem.

Moreover, in the baking by the high-frequency induction heating, since the covering layer is dried and the cross-linking reaction therein proceeds uniformly as described above, the charging site of the particle surface can be uniformly formed. Therefore, a single particle is uniformly charged irrespective of the place on the surface of the particle. Furthermore, the uniformity of the amount of charge among particles is improved and the distribution of the amount of charge of the carrier particles is made sharp.

Therefore, since no carrier has an extremely large amount of charge so that no particles are attracted to an image bearing member during development, the problem of carrier attachment in a solid image portion at the initial state is improved.

Furthermore, in the baking by the high-frequency induction heating, since the covering layer is dried and the cross-linking reaction therein proceeds uniformly as described above, a solid resin covering layer is formed, thereby improving the uniformity of the strength of the layer irrespective of the place of the surface of a single carrier particle and also improving the uniformity of the strength of the layer among particles. Therefore, since the layer strength can be made uniform at a high level as a whole, the abrasion resistance of the carrier is improved. Thus, carrier attachment to a solid image portion caused by a resistance decrease over time can be improved.

The baking temperature in the present disclosure is suitably determined considering the kind of resin and solvent and is preferably from 100° C. to 400° C. This is a suitable range for preservation in the high temperature and high moisture environment described above in terms of the solidification and the color contamination. When the baking temperature is too low, the temperature and the amount of heat applied to the covering layer tend to be insufficient so that the solidification problem in the high temperature and high moisture environment is not sufficiently improved.

To the contrary, when the baking temperature is too high, the covering layer tends to be decomposed, thereby making the covering layer blackish. That is, it is not suitable in terms of the color contamination and the quality of the carrier is markedly degraded, which is not preferable.

The baking temperature more preferably ranges from 120° C. to 300° C. This is a more suitable range in terms of the compatibility between the solidification and the color contamination in the high temperature and high moisture environment described above. The color contamination is a severe problem for full color in particular so that a low baking temperature is preferable. To the contrary, in the case of monochrome color, monochrome color is free from the color contamination problem (since it is not chromatic color). Therefore, a high baking temperature is preferable to improve the solidification problem in the high temperature and high moisture environment described above. However, this range is preferable in consideration of other quality degradation of the carrier.

The high-frequency induction heating in the present disclosure is a heating method generally referred to as high frequency induction heating, induction heating (IH), electromagnetic heating, etc. The mechanism of heating is as described above. In this method, an electroconductive material is directly heated without a medium so that the energy efficiency is extremely high.

There is no specific limit to the selection of any electroconductive metal for use in the high-frequency induction heating. However, the heating effect is great if a metal having a resistance in some degree is used.

FIG. 1 is a schematic diagram illustrating the state of the high-frequency induction heating of the present disclosure. A high frequency current supplied from a high frequency transmitter 3 flows in coil 4 to generate the magnetic lines of force, which generates an eddy current in a core material 1 covered with a covering material 2, thereby producing heat. This heat is used to raise the temperature of the covering material 2.

The solidification of the present disclosure represents a phenomenon in which carrier and toner particles stick together to form blocks and this phenomenon easily occurs in a high temperature and high moisture environment and in particular, in a high moisture environment.

As the solidification advances, for example, the development agent is solidified in the development unit to a degree that formed blocks are not crumbled by stirring in the development unit, the solidified blocks trip over a regulating board that uniformly regulates the amount of the development agent. Therefore, the development roller has a portion where no development agent is present, resulting in production of defective images with white streaks.

Furthermore, when the development agent is severely solidified, the driving power of a stirring wing in the development unit is insufficient to break up the blocks.

The color contamination of the present disclosure represents a drawback of dulling the color and narrowing the color representation range of a color image caused by a minute quantity of scraped covering layer produced during stirring in the development unit, which is transferred into toner particles and mingled into the image.

However minute the amount of the scraped covering layer of carrier particles may be, it greatly affects the color representation in the color image and in particular, yellow images.

The color contamination level said in the present disclosure is greatly different from that in a typical case. To be specific, the stress applied to the development agent drastically increases as the image forming speed increases so that a typical carrier having no color contamination problem is not allowable at this level.

Furthermore, the demand for the color quality is strong year by year. Therefore, the color contamination level that used to be allowable is not allowable now.

It is also found that using a conductive wire having a coil form having a single turn or multiple turns as the conductive material that generates the magnetic field by high frequency induction is good to increase the effect. In the high frequency induction, the magnetic lines of force are generated clockwise relative to the current flowing direction in the conductive wire. If this conductive wire is round to have a coil form, the magnetic lines of force in the coil are aligned in one direction and concentrated.

In addition, the improvement effect is found to increase by placing carriers the inner side of the conductive wire having a coil form.

This is because, as described above, the magnetic lines of force are concentrated inside the coil so that the eddy current efficiently flows in the core material of the carrier by placing the carrier in the concentrated magnetic lines of force to bake the carrier.

It is also found that the improvement is significant if the method of baking the carrier when the carrier is baked and the temperature of the core material rises is continuous and the carrier is transferred by a belt.

To bake a large amount of carriers, it is inevitable to continuously bake carriers. Therefore, a method is adopted which applies the magnetic lines of force from the conductive wire while transferring the carriers by a belt to perform this continuous baking, which is preferable in terms of efficiency. The belt represents a typical belt such as a belt conveyor. Furthermore, if a conductive material such as metal is arranged at a place that greatly receives magnetic lines of force generated by the conductive wire, the conductive material generates heat. Therefore, the material arranged at the portion that greatly receives magnetic lines of force is preferably formed of an insulating material.

Figure 2:
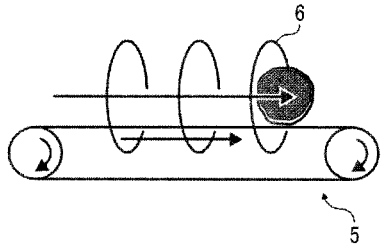
FIG. 2 is a diagram illustrating an example in which a belt-type transfer device is used as a device to continuously transfer core materials which is covered with a covering material.

FIG. 2 is a diagram illustrating a state in which magnetic lines of force 6 are applied to the core material covered with a covering material while the core material is being transferred by a belt conveyor 5.

It is also found that the improvement is significant if the method of baking the carrier when the carrier is baked and the temperature of the core material rises is continuous and the carrier is transferred by a screw. To bake a large amount of carriers, it is inevitable to continuously bake carriers. Therefore, a method is adopted which applies the magnetic lines of force from the conductive wire while transferring the carriers by a screw to perform this continuous baking, which is preferable in terms of efficiency. The screw represents, for example, a typical quantitative feeder type screw. Furthermore, if a conductive material such as metal is arranged at a place that greatly receives magnetic lines of force generated by the conductive wire, the conductive material generates heat. Therefore, the material arranged at the portion that greatly receives magnetic lines of force is preferably formed of an insulating material.

Figure 3:
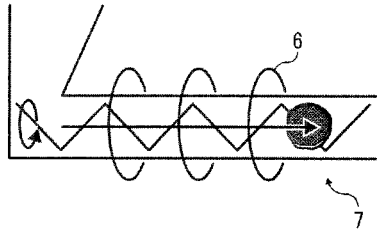
FIG. 3 is a diagram illustrating an example in which a screw-type transfer device is used as a device to continuously transfer core materials which is covered with a covering material.

FIG. 3 is a diagram illustrating a state in which magnetic lines of force 6 is applied to the core material covered with covering material while the core material is being transferred by a screw conveyor 7.

It is also found that the improvement is significant if the method of baking the carrier when the carrier is baked and the temperature of the core material rises is continuous and the carrier is transferred by vibration. To bake a large amount of carriers, it is inevitable to continuously bake carriers. Therefore, a method is adopted which applies the magnetic lines of force from the conductive wire while transferring the carriers by vibration to perform this continuous baking, preferable in terms of efficiency. The vibration represents, for example, a typical quantitative feeder type vibration.

Furthermore, if electroconductive material such as metal is arranged at a place that greatly receives magnetic lines of force generated by the conductive wire, the electroconductive material generates heat. Therefore, the material arranged at the portion that greatly receives magnetic lines of force is preferably formed of an insulating material.

Figure 4:
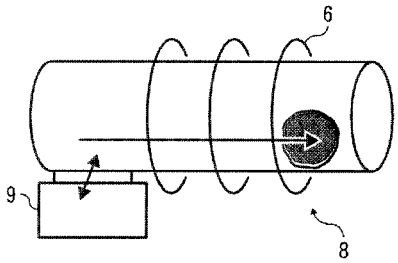
FIG. 4 is a diagram illustrating an example in which a vibration-type transfer device is used as a device to continuously transfer core materials which is covered with a covering material.

FIG. 4 is a diagram illustrating a state in which magnetic lines of force 6 is applied to the core material covered with covering material while the core material is being transferred by a vibration type transfer device 8 that is vibrated by a vibrator 9.

In addition, specific examples of the covering material that covers the carrier of the present disclosure include, but are not limited to, resins, cross-linking agents of resins, charge control agents, and inorganic particulates.

There is no specific limit to the selection of the resins that form the covering layer of the carrier of the present disclosure and any known resin typically for use in the carrier is suitably used.

Specific examples of such resins include, but are not limited to, silicone resins, fluorine resins, and acrylic resins. In addition, a single resin or a resin mixture can be used as the covering resin. Modified resins are also usable.

Specific examples of the resins include, but are not limited to, various kinds of thermoplastic resins, thermocuring resins such as polyolefin resins such as polyethylene, polypropylene, chlorinated polyethylene, and chlorosulfonated polyethylene, polystyrene, acrylic resins (e.g., polymethylmethacrylate), polyacrylonitrile, polyvinyl resins and polyvinylidene resins such as polyvinyl acetate, polyvinyl alcohol, polyvinyl butyral, polyvinyl chloride, polyvinyl carbazole, polyvinyl ether, and polyvinylketone, copolymers of vinyl chloride and vinyl acetate, fluorine resins such as polytetrafluoroethylene, polyvinyl fluoride, polyvinylidene fluoride, and polychlorotrifluoro ethylene, polyamide, polyester, polyurethane, polycarbonate, urea-formaldhyde resins, epoxy resins, silicone resins, urethane/urea resins, polyethylene resins, teflon (r) resins, and mixtures thereof, copolymers of such resins, blocked copolymers thereof, graft polymers thereof, and blended polymers thereof.

In the present disclosure, amino resins can be used as the cross-linking agent of resins. Any of amino resins can be used. It is preferable to use guanamine and melamine to extremely improve the ability of imparting charge amount. Moreover, in addition to the resins specified above, any typically used covering resins for carriers can be suitably used. Specific examples of such resins include, but are not limited to, various kinds of thermoplastic resins and thermocuring resins such as polystyrene resins, poly(meth)acrylic resins, polyolefin resins, polyamide resins, polycarbonate resins, polyether resins, polysulfinate resins, polyester resins, epoxy resins, polybutyral resins, urea resins, urethane/urea resins, silicone resins, polyethylene resins, teflon (r) resins, mixtures thereof, copolymers thereof, blocked copolymers thereof, and graft copolymers thereof, and blended copolymers thereof.

Specific examples of the charge control agents include, but are not limited to, silane coupling agents and titanium coupling agents.

For example, a specific example of the silane coupling agents is a compound represented by the following chemical structure.

$$YRSiX_3$$

X represents a hydrolytic group bonded with a silicon atom such as a chloro group, an alkoxy group, an acetoxy group, an alkyl amino group, and a propenoxy group. Y represents an organic functional group reactive with an organic matrix such as a vinyl group, a methacylic group, an epoxy group, a glycidoxy group, an amino group, and a mercapto group. R represents an alkyl group or an alkylene group having 1 to 20 carbon atoms.

Furthermore, among the silane coupling agents, to obtain a development agent having a negative chargeability, an amino silane coupling agent having an amino group for Y is preferable. To obtain a development agent having a positive chargeability, an epoxy silane coupling agent having an epoxy group for Y is preferable.

In the present disclosure, particles can be contained in the covering layer. Specific examples of such particulates include, but are not limited to, particulates of inorganic oxides such as silica, titanium oxide, alumina, zinc oxide, and tin oxide and particulates of organic resins such as phenol resins and melamine resins.

Furthermore, particulates formed by subjecting the surface of the particle base materials specified above to hydrophilic treatment, hydrophobic treatment, resistance decreasing treatment, etc.

In addition, there is no specific limit to the particle diameter. In terms of preserving the particle for an extended period of time, it is preferable that the particles are entirely embedded with the covering layer or the particle size is limited to three times or less as large as the average thickness of the covering layer. To be specific, the particle diameter is preferably from 0.01 to 1 μm and more preferably from 0.15 to 0.5 μm.

Although it is difficult to determine the content ratio of such particles considering the quality and the covering resin, the content ratio is preferably from 10 to 90% by weight and more preferably from 40 to 80% by weight.

In the present disclosure, a dilution solvent can be used to facilitate formation of layers of liquid of the covering layer on the core material. By using this dilution solvent, it is possible to properly control the drying speed, the surface tension, etc. of the liquid of the covering layer as well as the viscosity thereof so that the state of layer forming can be arbitrarily controlled.

In addition, there is no specific limit to the selection of the kind of the dilution solvent. It can be selected considering the kind of the liquid of the covering layer and the target layer forming. Specific examples of the dilution solvent include, but are not limited to, water, tetrahydrofuran, methanol, ethyl acetate, methylethylketone, ethyl cellosolve, butyl cellosolve, toluene, iso paraffin hydrocarbons (IP Solvent, IP Clean), isopropyl alcohol, and neocol.

The core material for the carrier of the present disclosure is heated by high frequency induction and a magnetized core material formed by the high frequency induction heating or core materials in or among which eddy current flows. Specific examples of known two-component carriers for use in electrophotography include, but are not limited to, iron, ferrite, magnetite, hematite, cobalt, iron-based metal, magnetite-based metal, Mn—Mg—Sn based ferrite, Mn-based ferrite, Mn—Mg ferrite, Li-based ferrite, Mn—Zn based ferrite, Cu—Zn based ferrite, Ni—Zn based ferrite, and Ba based ferrite. In addition, there is no specific limit to the particle diameter of the carrier core material particles. The particle diameter is preferably from 10 to 100 μm and more preferably from 20 to 60 μm.

Next, an example of the method of manufacturing the carrier of the present disclosure is described.

The method described below is just an example among a number of methods of manufacturing carriers and the methods of manufacturing the carrier of the present disclosure are not limited thereto.

The major flow of the method of manufacturing the carrier is as follows:

Weighing Raw material-Dispersion of Liquid of Covering Layer-Coating of Covering Layer-Baking-Pulverization First, weigh the raw material having a desired composition ratio followed by dispersion treatment by a dispersion device.

Any typically used dispersion device can be used as the dispersion device. Specific examples thereof include, but are not limited to, Homomixer, wing rotation type dispersion devices (Ebara Milder, Cavitron, etc.,) and Bead mills. The thus-obtained liquid dispersion is coated of the surface of the core material by a coating device. Any known coating device can be selected. For example, a rolling and flowing layer using a spray or a method of dipping the core material in a liquid dispersion followed by drying the solvent can be used. Then, the covering layer of the coated particle is baked to dry and proceed the cross-linking reaction.

A baking device that enables the high frequency induction heating is preferable. Finally, the particles agglomerated by baking are pulverized.

Any pulverizer that can pulverize down to a single particle can be used. In general, a screening device is mostly used and specific examples thereof include, but are not limited to, a vibration shifter and an ultrasonic vibration shifter. Furthermore, when such a shifter is used, not only is the agglomeration of the particles crumbled but also coarse particles and foreign objects are removed at the same time, which is preferable in terms of efficiency.

The thus obtained particles are the carrier particles of the present disclosure. The method described above is for illustration only and the method of manufacturing the carrier of the present disclosure is not limited thereto.

If the electric power of the high frequency induction heating device is raised, the alternating magnetization generated from the conductive material increases, thereby speeding up the temperature raising pace of the carrier. When the electric power E of the high frequency induction heating device per unit of weight of the carrier surpasses a certain value, the temperature of the carrier drastically rises by the large alternating magnetic field generated by the conductive material in which a high frequency current is flowing, which may decrease the magnetization of the carrier. Therefore, the electric power E is preferably 2.5 (kWh/kg) or less.

A carrier having a decreased magnetization is not able to be against the attraction force of electrostatic and drawn to the image bearing member, resulting in carrier attachment. The mechanism of a decrease of magnetization of the carrier is thought to be that, as a result of the drastic temperature rise, the structure of the core material itself is broken, which leads to the decrease of the magnetization.

Furthermore, the sudden temperature rise of the carrier provides a large amount of heat (energy) to the covering layer, which has an adverse impact on the color contamination by coloring the covering layer.

By contrast, when the electric power E of the high frequency induction heating device per unit of weight of the carrier is too low, for example, 0.01 (kWh/kg) or less, the alternating magnetic field generated from the conductive material tends to decrease, which makes it difficult to heat the carrier to the baking temperature and proceed the cross-linking reaction of the covering material.

If the cross-linking reaction does not proceed sufficiently, it is disadvantageous in terms of the carrier attachment at the initial state and over time.

In addition, the drying property of the residual solvent is poor, thereby degrading the solidification resistance. Therefore, the electric power per unit of time preferably ranges from 2 to 350 kW and more preferably from 2 to 200 kW. It is preferable to make the range of the electricity per unit of time of from 2 to 350 kW and more preferable to make it of from 2 to 200 kW to have a suitable alternating magnetic field value, dry the covering resin, and conduct the cross-linking reaction in a uniform state without decreasing the magnetization of the carrier as described above.

On the other hand, the weight of the carrier processed per hour preferably ranges from 10 to 400 kg/h and more preferably from 10 to 100 kg/h. It is preferable to make the range of the weight of the carrier processed per hour within the range of from 10 to 400 kg/h and more preferable to make it within the range of from 10 to 100 kg/h to limit the variance of the cross-linking of the covering material in the entire carrier to be small.

Furthermore, it is also found that the improvement is significant when the output frequency of the high frequency induction heating device is within the range of from 10 to 500 kHz.

Generally in the heating by electromagnetic wave containing high frequency induction heating, as the output frequency increases, the electromagnetic energy tends to be difficult to penetrate into a target so that the energy concentrates on the surface thereof.

For example, in the case of microwave heating, which generates a higher frequency (1,000 to 10,000 MHz) than that (3 to 300 MHz) of the high frequency induction heating, the temperature rising speed is high when heating a thinly covered material, which means that the heating efficiency is good. However, in the case of laminated carrier particles, the electromagnetic wave energy does not penetrate into the inside of the carrier particles so that only carrier particles having a thin surface layer are heated. Therefore, the microwave heating is disadvantageous in terms of uniform heating of the carriers. Furthermore, since the high frequency induction heating is induction heating to heat an electroconductive material and microwave heating is induction heating to heat an insulating material, the high frequency induction heating is efficient to heat the carrier because the carrier is an electroconductive material.

That is, in the baking (heating) of the carrier, the range of the output frequency of from 10 to 500 kHz is preferable in terms of heating efficiency and uniform heating of the carrier. When the output frequency is too small, it is not possible to heat the carrier to the baking temperature and the cross-linking reaction of the covering material does not proceed sufficiently. In addition, the drying property of the residual solvent is poor, resulting in degradation of the solidification resistance. By contrast, when the output frequency is too high, the carrier particles in the surface layer are markedly heated, thereby hindering uniform cross-linking in the covering material, resulting in a large variance of cross-linking in the entire carrier. This is disadvantageous to the carrier attachment at the initial state and over time.

Furthermore, it is also found that the improvement is significant when the output voltage of the high frequency induction heating device is within the range of from 200 to 1,500 V.

Also, it is found that a method of heating the carrier to the baking temperature slowly with a small output voltage is advantageous to dry the residual solvent in the covering material. However, when the output voltage is too small, it tends to be difficult to heat the carrier to the baking temperature because the alternating magnetic field generated by the conductive material in which a high frequency current is flowing decreases and consequently the cross-linking reaction of the covering material does not proceed sufficiently. If the cross-linking reaction does not proceed sufficiently, it is disadvantageous in terms of the carrier attachment at the initial state and over time. In addition, the drying property of the residual solvent is poor, thereby degrading the solidification resistance.

By contrast, when the output voltage is too large, the carrier is easily heated drastically because of a large alternating magnetic field generated by the conductive material in which a high frequency current is flowing as described above. Therefore, the magnetization of the carrier decreases, which causes the carrier attachment.

Furthermore, when the time length of maintaining the baking temperature by the high frequency induction heating device is within the range of from 0 to 60 minutes, it is found that the improvement is significant.

This is because a sufficient amount of heat (energy) is provided to proceed the cross-linking reaction in the covering material by controlling the time length of maintaining the baking temperature so that the cross-linking reaction proceeds sufficiently.

If the cross-linking reaction in the covering material does not proceed sufficiently, the solidification resistance deteriorates.

Furthermore, since the time to maintain the baking temperature is provided, the variance of the cross-linking among the entire carrier is made small, which is advantageous for the carrier attachment over time. However, when the time length is too long, excessive heat (energy) tends to be applied to the covering layer of the carrier, which causes the color contamination due to the coloring of the coloring layer.

The baking temperature can be determined to the selection of the covering material as described above.

The color toner in the present disclosure is not limited to color toner having a single color in general but includes black toner in addition to yellow toner, magenta toner, cyan toner, red toner, green toner, blue toner, etc. for use in full color image forming. Furthermore, the toner of the present disclosure represents any toner in general irrespective of monochrome toner, color toner, and full color toner. For example, the typically used pulverized toner and various kinds of polymerization toners that have been used in recent years are included.

Furthermore, toner containing a releasing agent, referred to as oil free toner, can be also used. In general, oil free toner contains a releasing agent. Therefore, the releasing agent tends to be transferred to the surface of the carrier, which is referred to as "spent". The carrier of the present disclosure has excellent "spent" resistance so that the carrier can maintain good quality. In the case of the oil free color toner, "spent" tends to occur because the binder resin is soft but the carrier of the present disclosure is extremely suitable.

Any known binder resin can be suitably used for the toner for use in the development agent of the present disclosure.

Specific examples of the binder resins include, but are not limited to, styrene polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-$\alpha$-methyl chloromethacrylate copolymers, styrene-acrylonitrile copolymers, styrene-vinyl methyl ether copolymers, styrene-vinyl methyl ketone copolymers, styrene-butadiene copolymers, styrene-isopropyl copolymers, and styrene-maleic acid ester copolymers; and other resins such as polymethyl methacrylate, polybutyl methacrylate, polyvinyl chloride, polyvinyl acetate, polyethylene, polyesters, epoxy resins, polyurethane resins, polyvinyl butyral resins, polyacrylic resins, rosin, modified rosins, terpene resins, phenol resins, aliphatic or aromatic hydrocarbon resins, and aromatic petroleum resins. These resins can be used alone or in combination.

Any mixture of known binder resins can be also suitably sued as the binder resin for pressure fixing.

Specific examples thereof include, but are not limited to, polyolefins such as low molecular weight polyethylenes and low molecular weight polypropylenes; olefin copolymers such as ethylene acrylic acid copolymers, styrene-methacrylic acid copolymers, ethylene methacryrate copolymers, ethylene-vinyl chloride copolymers, ethylene-vinyl acetate copolymers, and ionomer resins; epoxy resins, polyester resins, styrene-butadiene copolymers, polyvinyl pyrrolidone, methylvinyl ether-maleic anhydride, maleic acid modified phenol resins, and phenol modified terpene resins. These can be used alone or in combination.

In addition, the toner for use in the present disclosure may contain a fixing helping agent in addition to the binder resins, the coloring agent, and the charge control agent described above. Therefore, such toner can be used in a fixing system (oil free system) having a fixing roll free from a toner fixation prevention oil.

Any known fixing helping agents can be used. Specific examples thereof include, but are not limited to, polyolefins such as polyethylene and polypropylene, metal salts of aliphatic acid, esters of aliphatic acid, paraffin wax, amide waxes, polyalcohol waxes, silicone waxes, carnauba wax, ester waxes.

Any known pigments and dyes that can obtain each color toner of yellow, magenta, cyan, and black can be used for the color toner for use in the present disclosure.

Specific examples of the yellow pigments include, but are not limited to, cadmium yellow, mineral fast yellow, nickel titanium yellow, naval yellow, Naphthol yellow S, Hanza yellow G, Hanza yellow 10G, Benzidine yellow GR, quinoline yellow lake, permanent yellow NCG, and tartrazine lake.

Specific examples of orange pigments include, but are not limited to, molybdenum orange, permanent orange GTR, pyrazolone orange, Vulcan orange, indanthrene brilliant orange RK, benzidine orange GK, indanthrene brilliant orange GK.

Specific examples of red pigments include, but are not limited to, colcothar, cadmium red, permanent red 4R, lithol red, pyrazolone red, watching red calcium salt, lake red D, brilliant carmine 6B, Eosin Lake, Rhodamine Lake B, Alizarine Lake, and Brilliant Carmine 3B.

Specific examples of violet pigments include, but are not limited to, Fast Violet B and Methyl Violet Lake Specific examples of blue pigments include, but are not limited to, cobalt blue, Alkali Blue, Victoria Blue Lake, Phthalocyanine blue, metal-free Phthalocyanine Blue, partially chlorinated Phthalocyanine Blue, Fast Sky Blue, and Indanthrene Blue BC.

Specific examples of green pigments include, but are not limited to, Chrome Green, chromium oxide, Pigment Green B, and Malachite Green Lake.

Specific examples of black dyes include, but are not limited to, azine-based pigments such as carbon black, oil furnace black, channel black, lamp black, acetylene black, aniline black, metal salt azo pigments, metal oxides, and complex metal oxides.

These coloring agents can be used alone or in combination.

The toner such as color toner for use in the present disclosure may contain a charge control agent.

Specific examples thereof include, but are not limited to, azine-based dyes having an alkyl group having 2 to 16 carbon atoms (refer to JP-S42-1627-A), basic dyes such as C.I. Basic Yello 2 (C.I.41000), C.I. Basic Yello 3, C.I. Basic Red 1 (C.I.45160), C.I. Basic Red 9 (C.I.42500), C.I. Basic Violet (C.I.42535), C.I. Basic Violet 3 (C.I.42555), C.I. Basic Violet 10 (C.I.45170), C.I. Basic Violet 14 (C.I.42510), C.I. Basic Blue 1 (C.I.42025), C.I. Basic Blue 3 (C.I.51005), C.I. Basic Blue 5 (C.I.42140), C.I. Basic Blue 7 (C.I.42595), C.I. Basic Blue 9 (C.I.52015), C.I. Basic Blue 24 (C.I.52030), C.I. Basic Blue 25 (C.I.52025), C.I. Basic Blue 26 (C.I.44045), C.I. Basic Green 1 (C.I.42040), C.I. Basic Green 4 (C.I.42000), Lake pigments of these basic dyes, C.I. Solvent Black 8 (C.I. 26150), quaternary ammonium salts such as benzoyl methyl hexadecyl ammonium chloride and decyl trimethylchloride, dialkyl tin compounds such as dibutyl tin compounds and dioctyl tin compounds, dialkyl tin borates, guanidine derivatives, vinyl-based polymers having an amino group, polyamine resins such as condensed polymers having an amino group, metal complex salts of monoazo dyes specified in JP-S41-20153-A, JP-S43-27596-A, JP-S44-6397, and JP-S45-26478, salycylic acids described in JP-S55-42752 and S59-7385, metal (e.g., Zn, Al, Co, Cr, and Fe) complexes of diallkyl salycylic acid, naphthoic acid, and dicarbosylic acid, sulfonated copper phthalocyanine pigments, organic boron salts, fluorine-containing quaternary ammonium salts, and calixarene. Use of a charge control agent damaging the target color should be avoided for color toner other than black toner and metal salts of white salicylic derivatives are suitably used.

With regard to external additives, the transfer property and the durability of the toner are improved by externally adding inorganic particulates such as silica, titanium oxide, alumina, silicon carbide, silicon nitride, and boron nitride and resin particulates to mother toner particles. Such improvement is obtained by covering waxes that degrade the transfer property and the durability with such an external additive and reducing the contact area by covering the surface of the toner particles with such particulates. Among these, inorganic particulates having a hydrophobized surface are preferably used. Particulates of metal oxides such as silica and titanium oxide are suitably used.

With regard to the resin particulates, polymethacrylate or polystyrene particulates having an average particle diameter of from about 0.05 to about 1 μm manufactured by a soap-free emulsification method are suitably used.

Furthermore, a toner having a chargeability stable in a high moisture environment can be manufactured by using hydrophobized titanium oxide silica and hydrophobized titanium oxide in combination with the amount of the titanium oxide greater than that of the silica.

The durability of the toner can be improved by externally adding an external additive having a larger particle diameter than a typically used external additive such as silica having a specific surface area of from 20 to 50 $m^2/g$ and resin particulates having an average particle diameter one hundredth to one eighth of the average particle diameter of the toner.

This is because although metal oxide particulates externally added to the toner tend to be embedded in the mother toner particles while the toner is mixed and stirred with the carrier in the development device for triboelectric charging for development, this embedding of the metal oxide particulates is avoided by externally adding external additives having a larger particle diameter than these metal oxide particulates to the toner The inorganic particulates and resin particulates described above are less effective when contained inside toner particles than when externally added. However, the transfer property and the durability are improved and the pulverization property of the toner is also improved. Furthermore, in combinational use of external addition and internal addition, the externally added particulates are prevented from being embedded into the inside. Therefore, the transfer property is stable and excellent and the durability is also improved.

Specific examples of the hydrophobizing agents include, but are not limited to, dimethyldichlorosilane, trimethylchlorosilane, methyltrichlorosilane, aryldimethyldichlorosilane, arylphenyldichlorosilane, benzyldimethylmethylchlorosilane, bromomethyl dimethylchlorosilane, α-chloroethyltrichlorosilane, p-chloroethyltrichlorosilane, chlolomethyldimethylchlorosilane, chloromethyltrichlorosilane, p-chlorophenyl trichlorosilane, 3-chloropropyl trichlorosilane, 3-chloropropyl trimethoxysilane, vinyltriethoxysilane, vinylmethoxysilane, vinyl-tris(β-methoxyethoxy)silane, γ-methacryloxy propyltrimethoxysilane, vinyltriacetoxy silane, divinyldichlorosilane, dimethylvinyl chlorosilane, octyltrichlorosilane, decyltrichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyl-dimethyl-chlosilane, hexamethyl disilazane, hexaethyl disilazane, diethyltetramethyl dislazane, hexaphenyl dislazane, hexatolyl disilazane, and hexatolyl disilazane, In addition, titanate-based coupling agents and aluminum-based coupling agents can be also used. Moreover, lubricant particulates of metal salts of aliphatic acid and polyfluorinated vinylidene particulates can be used as an external additive to improve the cleaning property.

Toner for use in the present disclosure can be manufactured by any known method such as a pulverization method and a polymerization method.

In the pulverization method, batch-type double rolls, Bumbury's mixer, continuation-type two-axis extruders such as a KTK type two-axis extruder manufactured by Kobe Steel., Ltd., a TEM type two-axis extruder manufactured by Toshiba Machine Co., Ltd., a two-axis extruder manufactured by Asada Iron Works Co., Ltd., a PCM type two-axis extruder manufactured by Ikegai Ltd., and a KEX type two-axis extruder manufactured by Kurimoto Ltd., and a continuation-type one axis kneader such as Co-Kneader manufactured by Coperion Buss can be preferably used as a device to mix and knead a toner.

The melted and kneaded mixture obtained is thereafter cooled down followed by pulverization. As to the pulverization, the melted and kneaded mixture is coarsely-pulverized by, for example, a hammer mill, ROTOPLEX, etc., and then finely-pulverized by a fine pulverizer using a jet air or a mechanical fine pulverizer. It is preferred to pulverize the mixture in such a manner that the pulverized mixture has an average particle diameter of from 3 to 15 μm. Further, the pulverized mixture is preferred to be adjusted by, for example, an air classifier, in a manner that the size of the adjusted particles is from 5 to 20 μm.

Thereafter, external additives are attached to the mother toner. The external additives and the mother toner are mixed and stirred by a mixer, etc. While the external additives are pulverized, the surface of the mother toner is covered with the external additives. It is preferable to firmly and uniformly attach external additives such as inorganic particulates and resin particulates to the mother toner in terms of durability.

These are for illustration only and the present disclosure is not limited thereto.

Furthermore, it is also found that using a development agent for replenishment which has a blend ratio by weight of the toner to the carrier of from 2/1 to 50/1 contributes to further improvement. That is, such development agents for replenishment containing the carrier of the present disclosure and the toner are supplied to an image forming apparatus that forms images while discharging extra development agents in the development device. Therefore, quality images are stably produced for an extremely extended period of time. In addition, the blend ratio by weight of the toner to the carrier in the development agent for replenishment is preferably from 2/1 to 50/1.

When the blend ratio is too small, the amount of the carrier naturally increases excessively so that the amount of charge in the development agent increases, thereby changing the image density. By contrast, when the ratio is too large, the amount of the carrier decreases extremely, thereby reducing the substantial effect by carrier supply, which is not preferable.

Furthermore, it is also found that using a process cartridge accommodating the carrier of the present disclosure contributes to further improvement.

That is, by not containing the development agent but singly the carrier without the toner in the process cartridge, toner having required color can be replenished later, thereby unnecessitating preparation of a process cartridge for each color. That is, the process cartridge can be utilized for any color.

Furthermore, in an image forming apparatus that forms images while discharging extra development agent in the development unit, the carrier can be replenished into a development device for any color without preparing the development agent for replenishment for each color by singly supplying the carrier from the process cartridge to the development device. Thus, quality images are stably produced for an extremely extended period of time.

Furthermore, it is also found that using a process cartridge accommodating the development agent of the present disclosure contributes to further improvement.

By having such a process cartridge, any one can easily replace the process cartridge without requiring a special knowledge, technology, and environment when the development agent degraded over the use for an extended period of time is replaced. Therefore, it is not necessary to dissemble the development unit to draw out the degraded development agent followed by washing the development unit and place fresh development agents followed by assembling the development unit.

The process cartridge of the present disclosure is a device (part) including an image bearing member and at least one device selected from the group consisting of other optional devices such as a charging device, an irradiation device, a development device, a transfer device, a cleaning device, and a discharging device and detachably attachable to an image forming apparatus.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples and Comparative examples but not limited thereto.

Example 1

| | |
|---|---|
| Acrylic resin solution (Solid portion: 50% by weight) | 70 parts |
| Guanamine solution (Solid portion: 70% by weight) | 20 parts |
| Acid catalyst (Solid portion: 40% by weight) | 1 part |
| Silicone resin solution (Solid portion: 20% by weight) | 350 parts |
| Amino silane (Solid portion: 100% by weight) | 5 parts |
| Electroconductive-treated titanium particles (Surface: ITO treated, primary particle diameter: 50 nm, Volume specific resistance: $1.0 \times 10^2\ \Omega \cdot cm$) | 165 parts |
| Toluene | 700 parts |

The recipe specified above is dispersed by a Homomixer for ten minutes to prepare a liquid for forming a covering layer.

Next, the liquid for forming a covering layer is applied to core particles having an average particle diameter of 35 μm (baked ferrite powder, DFC-400M, Mn ferrite, manufactured by DOWAIP Creation Co., Ltd.) by a Spira Cota (manufactured by OKADA SEIKO CO., LTD.) at 60° C. inside the Spira Cota in such a manner that a layer having a thickness of 0.3 μm is formed on the surface of the core material.

The thus obtained coated carrier is placed still beside a hollow and bar form conductive wire having a diameter of 6 mm and a high frequency induction current of 200 V and 4 kW is generated in the conductive wire followed by baking at 160° C. for ten minutes. The hollow wire has a thickness of 1 mm with an inside diameter of 4 mm and heated by the high frequency induction current flowing in the wire. Therefore, cooling water is sent to flow inside the wire to remove this heat. The transmitter for the high frequency induction current is HOTSHOT 5 (6 kW) type, manufactured by Ambrell.

The thus baked carrier is cooled down and crumbled by using a shifter having an opening of 63 μm to obtain Carrier 1 having an amount of charge of 37 (−μc/g) and a volume specific resistance of 13.3 (Log(Ω·cm).

The toner is prepared by using the following recipe.

| | |
|---|---|
| Binder resin: polyester resin | 100 parts |
| Releasing agent: carnauba wax | 5 parts |
| Charge control agent (E-84, manufactured by Orient Chemical Industries Co., Ltd.): | 1 part |
| Coloring agent: C.I.P. Y. 180 | 8 parts |

The coloring agent, the binder resin, and pure water are mixed with a ratio of 1:1:0.5 and kneaded by a two roll.

The resultant is mixed and kneaded at 70° C. first and then the temperature of the rolls is raised to 120° C. to evaporate the water to prepare a master batch. The materials are weighed to be the same as the recipe specified above by using the thus obtained master batch and mixed by a Henschel Mixer followed by melting, mixing, and kneading by a two roll at 120° C. for 40 minutes. Subsequent to cooling down, the resultant is coarsely pulverized by a hammer mill and finely pulverized by an air jet pulverizer followed by classifying the finely pulverized powder to obtain mother toner particles having a weight average particle diameter of 5 μm.

Thereafter, one part of silica having a hydrophobized surface and one part of titanium oxide having a hydrophobized surface are added to 100 parts of the mother toner followed by mixing by a Henschel mixer to obtain Toner 1 (yellow toner).

7 parts of the thus obtained Toner 1 and 93 parts of Carrier 1 are mixed and stirred to prepare a first development agent having a toner concentration of 7% by weight.

Example 2

Carrier 2 is manufactured in the same manner as in Example 1 except that the conductive wire is changed to a coil having a single turn and the coated carrier is arranged outside the coil. The thus obtained Carrier 2 has an amount of charge of 37 (−μc/g) and a volume specific resistance of 13.4 (Log (Ω·cm). A second development agent is manufactured from the thus obtained Carrier 2 and Toner 1 in the same manner as in Example 1.

Example 3

Carrier 3 is manufactured in the same manner as in Example 2 except that the coated carrier is arranged inside the coil. The thus obtained Carrier 3 has an amount of charge of 40 (−μc/g) and a volume specific resistance of 13.5 (Log (Ω·cm). A third development agent is manufactured from the thus obtained Carrier 3 and Toner 1 in the same manner as in Example 1.

Example 4

Carrier 4 is manufactured in the same manner as in Example 3 except that the wire is changed to a coil having five turns. The thus obtained Carrier 4 has an amount of charge of 42 (−μc/g) and a volume specific resistance of 13.7 (Log (Ω·cm).

A fourth development agent is manufactured from the thus obtained Carrier 4 and Toner 1 in the same manner as in Example 1.

Example 5

Carrier 5 is manufactured in the same manner as in Example 4 except that the baking method of coated carrier particles is changed from placing still to continuous processing by placing the carrier on a heat resistant rubber belt of a belt conveyor and the coated carrier and the belt are arranged to pass through the inner side of the coil.

The thus obtained Carrier 5 has an amount of charge of 41 (−μc/g) and a volume specific resistance of 14.0 (Log(Ω·cm).

A fifth development agent is manufactured from the thus obtained Carrier 5 and Toner 1 in the same manner as in Example 1.

Example 6

Carrier 6 is manufactured in the same manner as in Example 4 except that the baking method of coated carrier particles is changed from placing still to continuous processing by placing the carrier in a feeder of a screw type and the cylinder of the conveying portion is arranged to pass through the inner side of the coil. The thus obtained Carrier 6 has an amount of charge of 43 (−μc/g) and a volume specific resistance of 13.9 (Log(Ω·cm).

A sixth development agent is manufactured from the thus obtained Carrier 6 and Toner 1 in the same manner as in Example 1.

Example 7

Carrier 7 is manufactured in the same manner as in Example 4 except that the baking method of coated carrier particles is changed from placing still to continuous processing by placing the carrier in a feeder of a vibration type and the conveying portion is arranged to pass through the inner side of the coil. The thus obtained Carrier 7 has an amount of charge of 42 (−μc/g) and a volume specific resistance of 13.8 (Log (Ω·cm).

A development agent is manufactured from the thus obtained Carrier 7 and Toner 1 in the same manner as in Example 1.

Example 8

Carrier 8 is manufactured in the same manner as in Example 6 except that the recipe for forming the covering layer is changed to the following. The thus obtained Carrier 8 has an amount of charge of 41 (−μc/g) and a volume specific resistance of 13.5 (Log(Ω·cm).

An eighth development agent is manufactured from the thus obtained Carrier 8 and Toner 1 in the same manner as in Example 1.

| | |
|---|---|
| Silicone resin solution (Solid portion: 20% by weight) | 597 parts |
| Amino silane (Solid portion: 100% by weight) | 5 parts |
| Electroconductive-treated titanium particles (Surface: ITO treated, primary particle diameter: 50 nm, Volume specific resistance: $1.0 \times 10^2$ Ω · cm) | 165 parts |
| Toluene | 700 parts |

Example 9

Carrier 9 is manufactured in the same manner as in Example 6 except that recipe for forming the covering layer is changed to the following.

The thus obtained Carrier 4 has an amount of charge of 42 (−μc/g) and a volume specific resistance of 13.8 (Log(Ω·cm).

A ninth development agent is manufactured from the thus obtained Carrier 9 and Toner 1 in the same manner as in Example 1.

| | |
|---|---|
| Acrylic resin solution (Solid portion: 50% by weight) | 169 parts |
| Guanamine solution (Solid portion: 70% by weight) | 48 parts |
| Acid catalyst (Solid portion: 40% by weight) | 2.5 parts |
| Amino silane (Solid portion: 100% by weight) | 5 parts |
| Electroconductive-treated titanium particles (Surface: ITO treated, primary particle diameter: 50 nm, Volume specific resistance: $1.0 \times 10^2$ Ω · cm | 165 parts |
| Toluene | 700 parts |

Example 10

Carrier 10 is manufactured in the same manner as in Example 6 except that the temperature of the carrier during baking is changed to 140° C. The thus obtained Carrier 10 has an amount of charge of 40 (−μc/g) and a volume specific resistance of 13.7 (Log(Ω·cm). A third comparative development agent is manufactured from the thus obtained Comparative carrier 3 and Toner 1 in the same manner as in Example 1.

Example 11

Carrier 11 is manufactured in the same manner as in Example 6 except that the temperature of the carrier during baking is changed to 180° C. The thus obtained Carrier 11 has an amount of charge of 43 (−μc/g) and a volume specific resistance of 13.8 (Log(Ω·cm). A development agent is manufactured from the thus obtained Carrier 11 and Toner 1 in the same manner as in Example 1.

Example 12

A first development agent for replenishment is manufactured in the same manner as in Example 6 with a blend ratio by weight of the toner to the carrier of 9/1 and evaluated. The development unit for evaluation in Example 12 has a mechanism in which the development agent automatically overflows when the amount thereof surpasses a certain amount to keep the amount of the development agent constant in the development unit.

Comparative Example 1

Comparative carrier 1 is manufactured in the same manner as in Example 1 except that the baking method is changed from the high frequency induction heating to an electric furnace and the carrier is left therein at 160° C. for one hour.

The thus obtained Comparative Carrier 1 has an amount of charge of 42 (−μc/g) and a volume specific resistance of 13.9 (Log(Ω·cm).

A first comparative development agent is manufactured from the thus obtained Comparative carrier 1 and Toner 1 in the same manner as in Example 1.

Comparative Example 2

Comparative carrier 2 is manufactured in the same manner as in Example 1 except that the baking method is changed from the high frequency induction heating to a rotary kiln and the carrier is left therein at 160° C. for one hour.

The thus obtained Comparative Carrier 2 has an amount of charge of 43 (−μc/g) and a volume specific resistance of 13.7 (Log(Ω·cm). A second comparative development agent is manufactured from the thus obtained Comparative carrier 2 and Toner 1 in the same manner as in Example 1.

Comparative Example 3

Comparative carrier 3 is manufactured in the same manner as in Comparative Example 1 except that the temperature of the carrier during baking is changed to 180° C. The thus obtained Comparative carrier 3 has an amount of charge of 40 (−μc/g) and a volume specific resistance of 14.0 (A third comparative development agent is manufactured from the thus obtained Comparative carrier 3 and Toner 1 in the same manner as in Example 1.

Comparative Example 4

Comparative carrier 4 is manufactured in the same manner as in Comparative Example 1 except that the temperature of the carrier during baking is changed to 200° C. The thus obtained Comparative carrier 4 has an amount of charge of 40 (−μc/g) and a volume specific resistance of 14.1 (Log(Ω·cm).

A fourth comparative development agent is manufactured from the thus obtained Comparative carrier 4 and Toner 1 in the same manner as in Example 1.

The development agents prepared in Examples 1 to 12 and Comparative Examples 1 to 4 are used for evaluation on carrier attachment on a solid image over time, solidification, and color contamination.

The results are shown in Table 1.

The measuring methods of the physical properties of the carriers obtained in Examples and Comparative Examples and the evaluation methods thereof are as follows.

Method of Measuring Amount of Charge

The amount of charge is measured for a sample formed by mixing the carrier and the toner with a mixing ratio of 93% by weight of the carrier to 7% by weight of the toner and being triboelectrically charged under a certain condition. The measuring value is obtained according to a typical blow-off method using TB-200 (manufactured by Kyocera Chemical Corporation).

Method of Measuring Volume Specific Resistance

The volume specific resistance is obtained by placing the carrier between parallel electrodes with a gap of 2 mm therebetween followed by tapping, applying DC 1,000 V between the electrodes, measuring the resistance after 30 seconds with a high resistance meter, and converting the measured resistance into the volume resistivity. If the resistance is below the lower limit of the high resistance meter, the volume specific resistance is not obtained and the carrier is treated as a breakdown.

Method of Evaluating Carrier Attachment on Solid Image Over Time

The development agent is placed in a machine remodeled based on a marketed product of a digital full color printer (imagio MP, C5000, manufactured by Ricoh Co., Ltd.) and tested for a run length of 1,000,000 prints.

After the actual machine test, the carrier attachment of the development agent on a solid image is evaluated.

The development agent on a solid image is evaluated by developing a total solid image on an A3 paper with a fixed background potential of 150 V by the printer described above followed by observation with a magnifying lens.

The carrier attachment is evaluated by the total number of the missing portions in the image and the carrier attached thereto.

Criteria on Carrier Attachment on Solid Image Over Time

A (supreme): zero
B (excellent): one
C (good): two to five
D (fair): six to ten
E (poor): 11 or more Evaluation of A, B, C, and D are determined as allowable and evaluation of E is determined as intolerable.

Method of Evaluating Solidification

To confirm the solidification state of the development agent in the development unit, solidification is evaluated on an A4 half tone solid image.

If the solidification is severe, blocks of the development agent are clogged behind the doctor blade of the development portion, which causes production of defective images having streaks. The degree of the state is evaluated according to the following.

The development agent is placed in the development hopper of a remodeled development unit set in a marketed product of a digital full color printer (IPSiO CX 8200, manufactured by Ricoh Co., Ltd.) with the development agent attached to the hopper in order not to fall onto the stirring portion and preserved in an environment test room at 55° C. and 95% RH for 48 hours. It is necessary to raise the temperature and humidity gradually to 55° C. and 95% RH to avoid dew drop when the development agent is preserved in the environment test room. After the 48 hour preservation, the development agent is placed in a room temperature environment for at least two hours to be cooled down to room temperature with normal humidity. Do not vibrate the development unit in this process. This is because solidified particles may be crumbled by vibration, which greatly affects the evaluation result.

To evaluate the degree of the solidification of the development agent preserved in the high temperature and high moisture environment, the seal attached to the development unit that separates the development agent hopper from the stirring portion of the development unit is pulled out to make the development agent fall into the stirring portion.

If the development agent is not solidified, the development agent smoothly falls into the stirring portion. If the development agent is severely solidified, the development agent does not fall into the stirring portion at all.

At this state, after the initial setting of the machine, a half solid image is output onto an A4 sheet and evaluated according to the following criteria.

Solidification Criteria

A (supreme): initial setting is possible and a good half tone image is obtained

B (Excellent): Initial setting is possible but a slight streak is confirmed on the half tone image.

C (Good): Initial setting is possible but a clear streak is confirmed on the half tone image.

D (Fair): A small amount of the development agent has fallen and the initial setting is made impossible with practical problems.

E (Poor): No amount of the development agent has fallen and the initial setting is made impossible with practical problems.

Evaluations of A, B, and C are determined as allowable and evaluations of D and E are determined as intolerable.

Method of Evaluating Color Contamination

The development agent is placed in a machine remodeled based on a marketed product of a digital full color printer (imagio MP, C5000, manufactured by Ricoh Co., Ltd.) and a one hour stirring is performed in the development unit without replenishment and development.

The thus obtained development agent is used for development and fixing and L*1, a*1, and b*1 values in the CIE color coordinate system are obtained for the portion where the image density is 1.5.

The L*1, a*1, and b*1 values in the CIE color coordinate system are measured by a spectrodensitometer (X-Rite 938, manufactured by X-Rite Corporation). On the other hand, to obtain an image free from color contamination, the image is formed (and fixed) by using a simple toner without contacting the carrier. The L*1, a*1, and b*1 values in the CIE color coordinate system are obtained for the portion where the image density is 1.5 as described above.

The color difference ΔE of the thus obtained two images is obtained from the following relationship and evaluated according to the following criteria:

Color Contamination Criteria

A (Supreme): ΔE is equal to or less than 0.5

B (Excellent): greater than 0.5 to 10

C (Good): greater than 10 to 20

D (Poor): greater than 20.

Evaluations of A, B, and C are determined as allowable and the evaluation of D is determined as intolerable.

TABLE 1

| | Carrier attachment on solid image over time | Solidification | Color contamination |
|---|---|---|---|
| Example 1 | D | C | B |
| Example 2 | D | C | B |
| Example 3 | C | B | B |
| Example 4 | A | A | B |
| Example 5 | A | A | B |
| Example 6 | A | A | B |
| Example 7 | A | A | B |
| Example 8 | C | A | B |
| Example 9 | B | B | B |
| Example 10 | C | B | A |
| Example 11 | B | A | C |
| Example 12 | A | A | B |
| Comparative Example 1 | E | D | C |
| Comparative Example 2 | E | D | C |
| Comparative Example 3 | C | C | D |
| Comparative Example 4 | B | A | D |

Criteria on Carrier Attachment on Solid Image Over Time
A (supreme), B (excellent), C (good), D (fair), E (poor)
E (poor) is intolerable
Solidification Criteria
A (supreme), B (excellent), C (good), D (fair), E (poor)
D (fair) and E (poor) are intolerable
Color Contamination Criteria
A: (supreme), B (excellent), C (good), D (poor)
D (poor) is intolerable As seen in the evaluation results shown in Table 1, the development agents of Examples 1 to 12 are better than those of Comparative Examples 1 to 4 with regard to the carrier attachment on solid image over time, solidification, and color contamination.

Example 13

| | |
|---|---|
| Acrylic resin solution (Solid portion: 50% by weight) | 70 parts |
| Guanamine solution (Solid portion: 70% by weight) | 20 parts |
| Acid catalyst (Solid portion: 40% by weight) | 1 part |
| Silicone resin solution (Solid portion: 20% by weight) | 350 parts |
| Amino silane (Solid portion: 100% by weight) | 5 parts |
| Electroconductive-treated titanium particles (Surface: ITO treated, primary particle diameter: 50 nm, Volume specific resistance: $1.0 \times 10^2\ \Omega \cdot cm$ | 165 parts |
| Toluene | 700 parts |

The recipe specified above is dispersed by a Homomixer for ten minutes to prepare a liquid for forming a covering layer.

Next, the liquid for forming a covering layer is applied to core particles having an average particle diameter of 35 μm (baked ferrite powder, DFC-400M, Mn ferrite, manufactured by DOWAIP Creation Co., Ltd.) by a Spira Cota (manufactured by OKADA SEIKO CO., LTD.) at 60° C. inside the Spira Cota in such a manner that a layer having a thickness of 0.3 μm is formed on the surface of the core material.

The thus obtained coated carrier is placed still in the inner side of a coil having three turns made of hollow conductive wire having a diameter of 6 mm. By setting the electric power W per unit of time to be 40.0 kW and the weight M of the carrier processes per hour to be 500 kg/h, the current is generated under the conditions of the electric power E of the high frequency induction heating device per unit of weight of the carrier of 0.80 kWh/kg, the output frequency of 480 kHz, and the output voltage of 220 V to bake the carrier at 160° C. for zero minutes. "Zero" minutes means that IH heating stops when the baking temperature of the product reaches 160° C.

The hollow conductive wire has a thickness of 1 mm with an inner diameter of 4 mm and heated by the high frequency induction current flowing in the wire. Therefore, cooling water is sent to flow inside the wire to remove this heat. EKOHEAT, manufactured by AMBRELL is used as the transmitter for the high frequency induction current.

The thus baked carrier is cooled down and crumbled by using a shifter having an opening of 63 μm to obtain Carrier 13. 93 parts of the thus obtained Carrier 13 is mixed and stirred with 7 parts of Toner 1 to prepare a thirteenth development agent having a toner concentration of 7% by weight.

Example 14

Carrier 14 is manufactured in the same manner as in Example 13 except that the electric power W per unit of time is changed to 1.50 kW and thus the electric power E of the high frequency induction heating device per unit of weight of the carrier is changed to 0.03 kWh/kg.

A fourteenth development agent is manufactured from the thus obtained Carrier 14 and Toner 1 in the same manner as in Example 13.

Example 15

Carrier 15 is manufactured in the same manner as in Example 13 except that the electric power W per the unit of time is changed to 115 kW and thus the electric power E of the high frequency induction heating device per the unit of weight of the carrier is changed to 2.30 kWh/kg.

A fifteenth development agent is manufactured from the thus obtained Carrier 15 and Toner 1 in the same manner as in Example 13.

Example 16

Carrier 16 is manufactured in the same manner as in Example 13 except that the output frequency is changed to 5.0 kHz.

A sixteenth development agent is manufactured from the thus obtained Carrier 16 and Toner 1 in the same manner as in Example 13.

Example 17

Carrier 17 is manufactured in the same manner as in Example 13 except that the output frequency is changed to 30.0 kHz.

A seventeenth development agent is manufactured from the thus obtained Carrier 17 and Toner 1 in the same manner as in Example 13.

Example 18

Carrier 18 is manufactured in the same manner as in Example 13 except that the output frequency is changed to 520.0 kHz.

A eighteenth development agent is manufactured from the thus obtained Carrier 18 and Toner 1 in the same manner as in Example 13.

Example 19

Carrier 19 is manufactured in the same manner as in Example 13 except that the output voltage is changed to 180 V and thus the electric power W per unit of time is changed to 32.7 kW so that the weight M of the carrier processes per hour is changed to 40.9 kg/h to maintain the electric power E of the high frequency induction heating device per unit of weight of the carrier to be 0.80 kWh/kg. A nineteenth development agent is manufactured from the thus obtained Carrier 19 and Toner 1 in the same manner as in Example 13.

Example 20

Carrier 20 is manufactured in the same manner as in Example 13 except that the output voltage is changed to 1,480 V and thus the electric power W per unit of time is changed to 269 kW so that the weight M of the carrier processes per hour is changed to 336 kg/h to maintain the electric power E of the high frequency induction heating device per the unit of weight of the carrier to be 0.80 kWh/kg.

A twentieth development agent is manufactured from the thus obtained Carrier 20 and Toner 1 in the same manner as in Example 13.

Example 21

Carrier 21 is manufactured in the same manner as in Example 13 except that the output voltage is changed to 1,520 V and thus the electric power W per unit of time is changed to 276 kW so that the weight M of the carrier processes per hour is changed to 345 kg/h to maintain the electric power E of the high frequency induction heating device per unit of weight of the carrier to be 0.80 kWh/kg. A 21st development agent is manufactured from the thus obtained Carrier 21 and Toner 1 in the same manner as in Example 13.

Example 22

Carrier 22 is manufactured in the same manner as in Example 13 except that the holding time is changed to 50 minutes.

A 22nd development agent is manufactured from the thus obtained Carrier 22 and Toner 1 in the same manner as in Example 13.

Example 23

Carrier 22 is manufactured in the same manner as in Example 13 except that the holding time is changed to 70 minutes.

A 23rd development agent is manufactured from the thus obtained Carrier 23 and Toner 1 in the same manner as in Example 13.

Example 24

Carrier 24 is manufactured in the same manner as in Example 13 except that the holding time is changed to 30 minutes.

A 24th development agent is manufactured from the thus obtained Carrier 24 and Toner 1 in the same manner as in Example 13.

Example 25

Carrier 25 is manufactured in the same manner as in Example 13 except that the temperature during baking is changed to 200° C. and the recipe for forming the covering layer is changed to the following.

A development agent is manufactured from the thus obtained Carrier 25 and Toner 1 in the same manner as in Example 13.

| | |
|---|---|
| Silicone resin solution (Solid portion: 20% by weight) | 597 parts |
| Amino silane (Solid portion: 100% by weight) | 5 parts |
| Electroconductive-treated titanium particles (Surface: ITO treated, primary particle diameter: 50 nm, Volume specific resistance: $1.0 \times 10^2\ \Omega \cdot cm$ | 165 parts |
| Toluene | 700 parts |

Example 26

Carrier 26 is manufactured in the same manner as in Example 13 except that the temperature during baking is changed to 180° C. and the recipe for forming the covering layer is changed to the following.

A development agent is manufactured from the thus obtained Carrier 26 and Toner 1 in the same manner as in Example 13.

| | |
|---|---|
| Acrylic resin solution (Solid portion: 50% by weight) | 169 parts |
| Guanamine solution (Solid portion: 70% by weight) | 48 parts |
| Acid catalyst (Solid portion: 40% by weight) | 2.5 parts |
| Amino silane (Solid portion: 100% by weight) | 5 parts |
| Electroconductive-treated titanium particles (Surface: ITO treated, primary particle diameter: 50 nm, Volume specific resistance: $1.0 \times 10^2\ \Omega \cdot cm$ | 165 parts |
| Toluene | 700 parts |

Example 27

Carrier 27 is manufactured in the same manner as in Example 13 except that the electric power W per the unit of time is changed to 0.40 kW and thus the electric power E of the high frequency induction heating device per unit of weight of the carrier is changed to 0.008 kWh/kg.

A 27th development agent is manufactured from the thus obtained Carrier 27 and Toner 1 in the same manner as in Example 13.

Examples 28

Carrier 28 is manufactured in the same manner as in Example 13 except that the electric power W per unit of time is changed to 135 kW and thus the electric power E of the high frequency induction heating device per unit of weight of the carrier is changed to 2.70 kWh/kg. A development agent is manufactured from the thus obtained Carrier 28 and Toner 1 in the same manner as in Example 13.

Comparative Example 5

Comparative Carrier 5 is manufactured in the same manner as in Example 13 except that the baking method is changed from the high frequency induction heating to microwave heating and the recipe is baked by a microwave heating device (microwave batch type oven, manufactured by Micro Denshi Co., Ltd. under the conditions of the electric power E of the microwave heating device per the unit of weight of the carrier of 0.80 kWh/kg, the output frequency of 245 kHz, and the output voltage of 220 V at 160° C.

A fifth comparative development agent is manufactured from the thus obtained Comparative carrier 5 and Toner 1 in the same manner as in Example 13.

Comparative Example 6

Comparative carrier 6 is manufactured in the same manner as in Example 13 except that the baking method is changed from the high frequency induction heating to an electric furnace and the carrier is left therein at 160° C. for one hour.

A sixth comparative development agent is manufactured from the thus obtained Comparative carrier 6 and Toner 1 in the same manner as in Example 13.

Comparative Example 7

Comparative carrier 7 is manufactured in the same manner as in Example 13 except that the baking method is changed from the high frequency induction heating to an electric furnace and the carrier is left therein at 180° C. for one hour. A seventh comparative development agent is manufactured from the thus obtained Comparative carrier 7 and Toner 1 in the same manner as in Example 13.

The development agents prepared in Examples 13 to 28 and Comparative Examples 5 to 7 are evaluated with regard to the carrier attachment on a solid image at initial state and over time, solidification, and color contamination.

The results are shown in Table 2.

The measuring methods of the physical properties of the carriers obtained in Examples and Comparative Examples and the evaluation methods thereof are as follows.

Method of Evaluating Carrier Attachment on Solid Image at Initial State

The development agent is placed in a machine remodeled based on a marketed product of a digital full color printer (imagio MP, C5000, manufactured by Ricoh Co., Ltd.) and evaluated on the carrier attachment on a solid image of the development agent at initial stage.

In the evaluation method, ten solid images are developed and fixed continuously on the entire of A3 sheets after the development agent is set in the printer while the background potential is fixed at 150 V The thus obtained solid images are observed by a magnifying glass to count the number of the missing portions of the image and the carrier attached thereto. The total number is determined as the number of the carrier attachment of the image.

The average of the evaluated ten images are determined as the number of the carrier attachment of the development agent at initial state and evaluated as follows.

A (Excellent): zero
B (good): one to seven
C (fair): eight to 15
D (poor): 16 or more Evaluation of A, B, and C are determined as allowable and evaluation of D is determined as intolerable.

Method of Evaluating Carrier Attachment on Solid Image Over Time

The development agent is placed in a machine remodeled based on a marketed product of a digital full color printer (imagio MP, C5000, manufactured by Ricoh Co., Ltd.) and tested for a run length of 300,000 prints. After the actual machine test, the carrier attachment of the development agent on a solid image is evaluated.

The development agent on a solid image is evaluated by developing a total solid image on an A3 paper with a fixed background potential of 150 V by the printer described above followed by observation with a magnifying lens.

The carrier attachment is evaluated by the total number of the missing portions in the image and the carrier attached thereto.

A (excellent): zero

B (good): one to five

C (fair): six to ten

D (poor): 11 or more

Evaluation of A, B, and C are determined as allowable and evaluation of D is determined as intolerable.

Evaluation Method on Solidification

To confirm the solidification state of the development agent in the development unit, solidification is evaluated on an A4 half tone solid image. If the solidification is severe, blocks of the development agent are clogged behind the doctor blade of the development portion, which causes production of defective images having streaks. Therefore, the degree of the state is evaluated as follows.

The development agent is placed in the development hopper of a remodeled development unit set in a marketed product of a digital full color printer (IPSiO CX 8200, manufactured by Ricoh Co., Ltd.) with the development agent attached to the hopper in order not to fall onto the stirring portion and preserved in an environment test room at 55° C. and 95% RH for 48 hours. It is necessary to raise the temperature and humidity gradually to 55° C. and 95% RH to avoid dew drop when the development agent is preserved in the environment test room. After the 48 hour preservation, the development agent is placed in the room temperature environment and left for at least two hours to be cooled down to the room temperature and normal humidity. Do not vibrate the development unit in this process. This is because solidified particles may be crumbled by vibration, which greatly affects the evaluation result.

To evaluate the degree of the solidification of the development agent preserved in the high temperature and high moisture environment, the seal attached to the development unit that separates the development agent hopper from the stirring portion of the development unit is pulled out to make the development agent fall into the stirring portion. If the development agent is not solidified, the development agent smoothly falls into the stirring portion. If the development agent is severely solidified, the development agent does not fall into the stirring portion at all. At this state, after the initial setting of the machine, a half solid image is output onto an A4 sheet and evaluated according to the following criteria.

Solidification Criteria

A (supreme): Initial setting is possible and a good half tone image is obtained.

B (Excellent): Initial setting is possible but a slight streak is confirmed on the half tone image.

C (Good): Initial setting is possible but a clear streak is confirmed on the half tone image.

D (Fair): A small amount of the development agent has fallen and the initial setting is made impossible with practical problems.

E (Poor): No amount of the development agent has fallen and the initial setting is made impossible with practical problems.

Evaluations of A, B, and C are determined as allowable and evaluations of D and E are determined as intolerable.

Method of Evaluating Color Contamination

The development agent is placed in a machine remodeled based on a marketed product of a digital full color printer (imagio MP, C5000, manufactured by Ricoh Co., Ltd.) and a one hour stirring is performed in the development unit without replenishment and development.

The thus obtained development agent is used for development and fixing and L*1, a*1, and b*1 values in the CIE color coordinate system are obtained for the portion where the image density is 1.5. The L*1, a*1, and b*1 values in the CIE color coordinate system are measured by a spectrodensitometer (X-Rite 938, manufactured by X-Rite Corporation).

On the other hand, to obtain an image having free from color contamination, the image is formed (and fixed) by using a simple toner without contacting the carrier. The L*1, a*1, and b*1 values in the CIE color coordinate system are obtained for the portion where the image density is 1.5 as well as the described above. The color difference ΔE of the thus obtained two images is obtained from the following relationship and evaluated as follows:

Color Contamination Criteria

S (Supreme): ΔE is equal to or less than 0.5

E (Excellent): greater than 0.5 to 1.25

G (Good): greater than 1.25 to 2.00

B (Bad): greater than 2.00

Evaluations of S, E, and G are determined as allowable and the evaluation of B are determined as intolerable.

$$\Delta E=\sqrt{(L^*0-L^*1)^2+(a^*0-a^*1)^2+(b^*0-b^*1)^2} \quad \text{Relationship 1}$$

TABLE 2

| | Carrier attachment on solid image at initial state | Carrier attachment on solid image over time | Solidification | Color contamination |
|---|---|---|---|---|
| Example 13 | A | B | B | B |
| Example 14 | A | C | C | B |
| Example 15 | C | B | B | B |
| Example 16 | A | B | C | B |
| Example 17 | A | B | B | B |
| Example 18 | B | C | B | B |
| Example 19 | A | C | C | B |
| Example 20 | B | B | B | B |
| Example 21 | C | B | B | B |
| Example 22 | A | A | A | B |
| Example 23 | A | A | A | C |
| Example 24 | A | A | A | A |
| Example 25 | B | C | B | B |
| Example 26 | A | B | C | B |
| Example 27 | B | C | D | B |
| Example 28 | D | B | C | D |
| Comparative Example 5 | C | D | E | D |
| Comparative Example 6 | D | D | D | C |
| Comparative Example 7 | D | D | C | D |

Criteria on Carrier Attachment on Solid Image At Initial State
A (excellent), B (good), C (fair), D (poor)
D (poor) is intolerable
Criteria on Carrier Attachment on Solid Image Over Time
A (excellent), B (good), C (fair), D (poor)
D (poor) is intolerable
Solidification Criteria
A (supreme), B (excellent), C (good), D (fair), E (poor)
D (fair) and E (poor) are intolerable
Color Contamination Criteria
A: (supreme), B (excellent), C (good), D (poor)
D (poor) is intolerable As seen in the evaluation results shown in Table 2, the development agents of Examples 13 to 28 are better than those of Comparative Examples 5 to 7 with regard to the carrier attachment on solid image at initial state and over time, solidification, and color contamination.

When the carrier of the present disclosure is used in combination with toner as a development agent, no carrier attachment occurs to a solid image at initial state and over time. Since the solidification resistance of the carrier is good and color contamination resistance thereof is good, the carrier is suitably used to visualize a latent electrostatic image with the toner.

This document claims priority and contains subject matter related to Japanese Patent Applications nos. 2010-153571, 2011-034567, and 2011-059112, filed on Jul. 6, 2010, Feb. 21, 2011, and Mar. 17, 2011, respectively, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing a carrier comprising:

(a) covering a core material with a covering material to form a covering layer on the core material, the covering material comprising a solvent; and (b) baking the covering material by heating the core material by high frequency induction applied thereto by a high frequency induction heating device, wherein a magnetic field generated by the high frequency induction heating device is generated by flowing a current in a conductive wire having a coil form having a single turn or multiple turns, to heat the core material in (b), and thereby heat the covering layer, wherein the heating of the covering layer causes the solvent to pass through the covering layer in a direction away from the core material, and wherein an electric power E of the high frequency induction heating device per unit of weight of the carrier is represented by the following Relationship 1 and ranges from 0.01 to 2.5 kWh/kg, $$E=W/M \qquad \text{Relationship 1}$$

where W represents electric power per unit of time and M represents a weight of the carrier processed per hour.

2. The method of manufacturing a carrier according to claim 1, wherein the covering layer comprises a covering resin, the covering resin being cross-linked in the step of baking.

3. The method of manufacturing a carrier according to claim 1, wherein the core material covered with the covering material is placed inside the conductive wire having a coil form.

4. The method of manufacturing a carrier according to claim 1, wherein the core material covered with the covering material is transferred continuously in the magnetic field to apply magnetic lines of force to the core material.

5. The method of manufacturing a carrier according to claim 4, wherein the core material covered with the covering material is transferred continuously by a belt.

6. The method of manufacturing a carrier according to claim 4, wherein the core material covered with the covering material is transferred continuously by a screw.

7. The method of manufacturing a carrier according to claim 4, wherein the core material covered with the covering material is transferred continuously by vibration.

8. The method of manufacturing a carrier according to claim 1, wherein an output frequency of the high frequency induction heating device ranges from 10 to 500 kHz.

9. The method of manufacturing a carrier according to claim 1, wherein an output voltage of the high frequency induction heating device ranges from 200 to 1,500 V.

10. The method of manufacturing a carrier according to claim 1, wherein a holding time of a temperature of the baking by the high frequency induction heating device is greater than 0 minutes and no more than 60 minutes.

11. The method of manufacturing a carrier according to claim 1, wherein an output frequency of the high frequency induction heating device ranges from 480 kHz to 500 kHz.

12. The method of manufacturing a carrier according to claim 1, wherein the covering layer comprises particulates of an inorganic oxide.

* * * * *